United States Patent [19]

Koepsel et al.

[11] 4,331,429

[45] May 25, 1982

[54] SYMMETRICAL PROPELLER

[75] Inventors: Roger E. Koepsel; Ronald M. Steiner; Daniel G. Wilcox, all of Oshkosh, Wis.

[73] Assignee: Brunswick Corporation, Skokie, Ill.

[21] Appl. No.: 106,588

[22] Filed: Dec. 26, 1979

[51] Int. Cl.[3] ..... B63H 1/26

[52] U.S. Cl. ..... 440/49; 416/93 A; 416/223 R; 440/89

[58] Field of Search ..... 440/49, 66, 89, 76, 440/78; 416/93 A, 223 R, 238, 242, 244 B

[56] References Cited

U.S. PATENT DOCUMENTS

| | | | |
|---|---|---|---|
| 424,056 | 3/1890 | Gibert | 416/223 |
| 2,116,055 | 5/1938 | Weichwald | 416/223 |
| 2,609,055 | 9/1952 | Monroe | 416/223 |
| 3,434,447 | 3/1969 | Christensen et al. | 440/89 X |
| 4,023,353 | 5/1977 | Hall | 440/89 X |

FOREIGN PATENT DOCUMENTS

| | | | |
|---|---|---|---|
| 153111 | 1/1956 | Sweden | 416/223 |
| 13395 | of 1903 | United Kingdom | 416/223 |
| 379647 | 9/1932 | United Kingdom | 416/242 |
| 424658 | 2/1935 | United Kingdom | 416/223 |

*Primary Examiner*—Johnny D. Cherry

[57] ABSTRACT

A propeller (18) having an exhaust discharge passage (22) through the propeller hub has blades (24) symmetrical in thickness about the nose-tail pitch line and symmetrical in plan form about a rake line (26). The propeller (18) is particularly effective to increase reverse thrust when used with an outboard drive unit (10) having exhaust gas relief passages (27).

5 Claims, 7 Drawing Figures

SYMMETRICAL PROPELLER

DESCRIPTION

1. Technical Field

This invention relates to propellers for outboard drive units and particularly to propellers having engine exhaust gas discharge passages through the hub of the propeller.

In the operation of outboard drive units which discharge engine exhaust through the hub of the propeller, it is difficult to achieve high reverse thrust.

2. Background Art

A variety of devices have been used to prevent the discharge of engine exhaust through the hub of a propeller when reverse drive is desired, while allowing it to discharge through the propeller hub when forward drive is desired.

DISCLOSURE OF INVENTION

A marine propeller has an exhaust gas discharge opening at its aft end. The propeller has a plurality of blades, each symmetrical in thickness about their nose-tail pitch lines. The propeller has a substantially increased reverse thrust compared to standard propellers having exhaust discharge through the hub. It is particularly effective when used in combination with an outboard drive unit having exhaust gas relief passages to avoid substantial discharge through the propeller hub when the unit is in reverse drive.

BEST MODE FOR CARRYING OUT THE INVENTION

Figure 1:
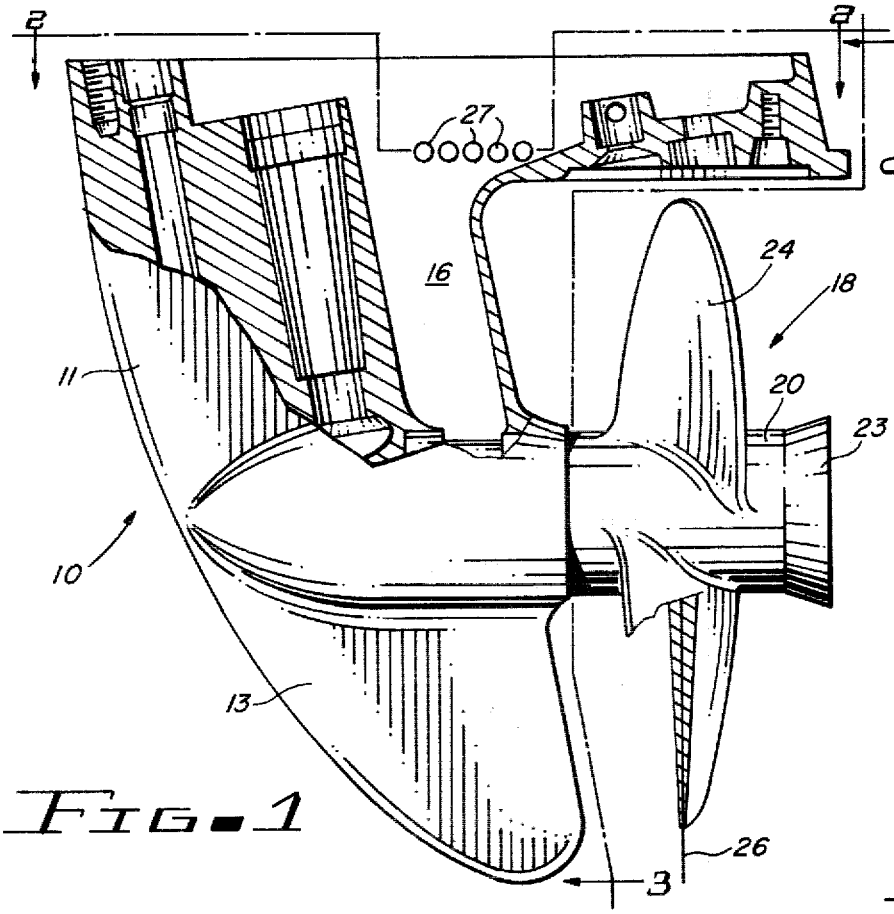
FIG. 1 shows the lower unit of an outboard drive unit according to the invention.
Figure 3:
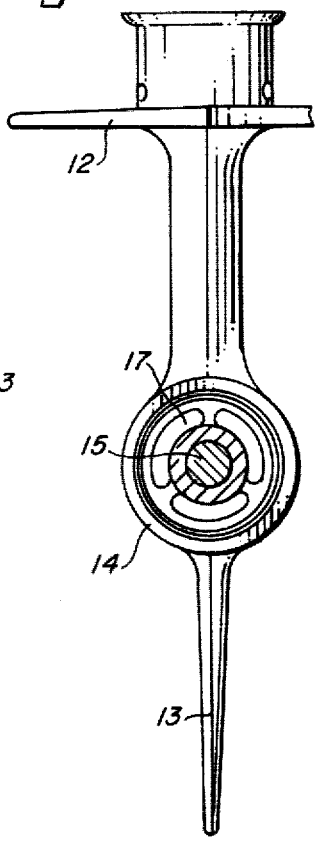
FIGS. 2 and 3 are taken along lines 2—2 and 3—3, respectively of FIG. 1.
Figure 2:
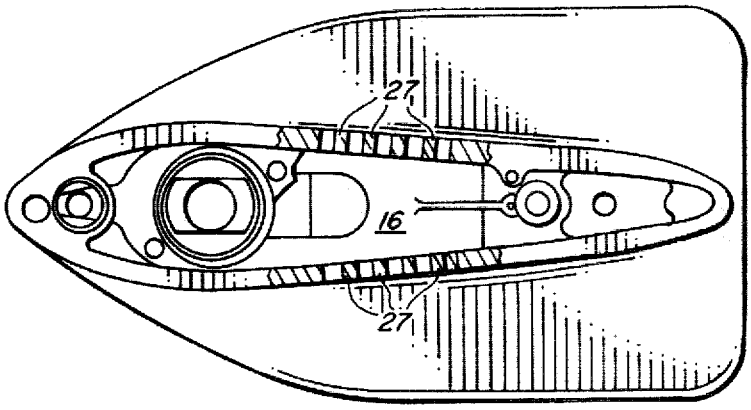

Referring to the drawings, the FIGS. 1-3 show the lower unit 10 of an outboard drive. Such units are well known and generally include a housing 11, an integral anti-ventillation plate 12, a skeg 13, and a torpedo 14 which houses the drive gears for the propeller shaft 15. The housing 11 includes an internal exhaust gas passageway 16 which terminates at the aft end of the torpedo 14 in an annular opening 17.

The propeller 18 of the invention includes an inner hub 19 adapted to mount on the propeller shaft 15. The propeller 18, shown partially in section in FIG. 1, includes an outer hub 20, spaced from the inner hub 19 by supports 21 to define an annular exhaust passage 22. The exhaust passage 22 communicates with passageway 16 so that exhaust gases escape through the rear of propeller 18 and into the water. A flare or diffuser ring 23 is provided on the aft end of the outer hub 20 to assist exhaust gas flow and prevent exhaust gas from feeding back into the propeller blades 24. In forward drive, this arrangement results in the exhaust gases being discharged into the area of lowest water pressure.

In reverse drive the area at the aft end of the propeller 18 becomes an area of high water pressure. Consequently, discharge of exhaust gases into this area when the drive 10 is in reverse decreases engine performance. Furthermore, propeller performance is substantially reduced because of the feedback of exhaust gases into the propeller blades. Accordingly, exhaust gas relief passages 27 are provided to give an alternate exhaust discharge passage into an area of lower water pressure when the drive 10 is reversed. These relief passages 27 are sized large enough to handle the maximum engine exhaust gas flow without increasing the exhaust back pressure above the water pressure existing at the aft end of the propeller 18 with the drive in reverse.

Figure 7:
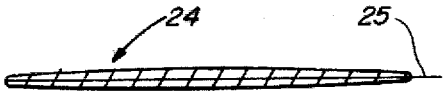
FIG. 5, 6 and 7 are sectional views of the propeller blade taken along lines 5—5, 6—6, and 7—7, respectively.
Figure 5:
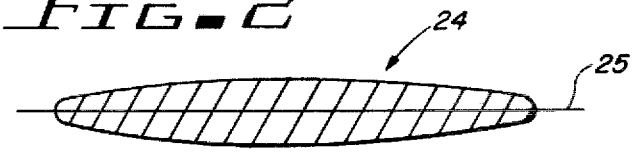
Figure 4:
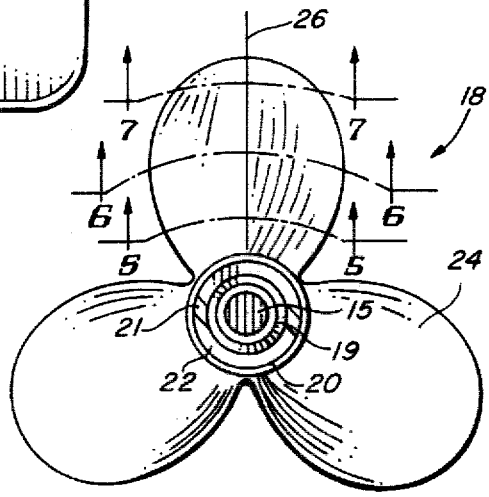
FIG. 4 is a front view of the propeller of the invention.
Figure 6:
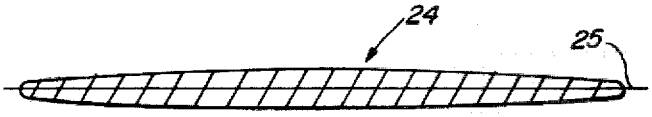

The propeller 18 has three blades 24, each having its thickness symmetrical about a straight line from the nose to the tail of the blade (mean pitch line) 25, as most clearly shown in FIGS. 5, 6 and 7. Preferably the blade should have a modified circular arc chord section with the maximum blade thickness at 50% of the chord length. The propeller is designed so that each blade's planform and thickness are symmetrical about a rake line 26 with a slightly negative rake on each blade surface, resulting from the increasing blade thickness as the root is approached. As a result the flow over the propeller 18 is essentially the same in forward or reverse. The blades have a large leading and trailing edge radii (0.04–0.05 inches). The propeller of the invention provides essentially the same leading edge contour in either direction, while a more conventional propeller with a nearly flat pitch face and positive camber will present a much different leading edge contour in reverse compared to forward, especially at the high angles of attack encountered at static thrust conditions.

To provide a high blade area ratio of approximately 55%, each of the blades are provided with a root chord that extends approximately 120° at the outer hub 20 surface. Blade area ratio is defined as the ratio of the total positive pressure surface area of the blades, measured outwardly from the hub, to the area of the circle the blade tips proscribe.

Tests conducted by the inventors have demonstrated that propellers constructed within the above specifications will produce substantially greater static reverse thrust than a more conventional propeller. For test purposes a "standard" propeller having a blade area ratio of 50%, a pitch of 7 inches, a −5° blade rake and a diameter of 8.75 inches was compared with a propeller as described above having a blade area ratio of 55%, a pitch of 7 inches, a −3° blade rake on both the fore and aft blade faces, and a diameter of 9.0 inches. The test results, using a Mercury 9.8 horsepower outboard motor, showed the propeller according to the invention to produce 190 pounds static thrust in reverse with exhaust relief as described above and 90 to 100 pounds thrust with no exhaust relief. The "standard" propeller produced 130 to 140 pounds thrust with exhaust relief and 60 to 70 pounds thrust without exhaust relief under the same conditions. In forward drive the propeller of the invention produced 170 to 180 pounds static thrust while the "standard" propeller produced 190 pounds thrust.

As can be seen from the above the invention provides a unique solution to the problem of providing satisfactory reverse thrust with outboard motors having exhaust gas discharge through the propeller hub. The invention is particularly useful on sailboats and other installation operating at slow speed.

We claim:

1. A marine propeller comprising a hub having an exhaust gas discharge opening at the aft end thereof and a plurality of blades extending from said hub forwardly of said opening, said blades each having a thickness radially symmetrical about a rake line, a plan form symmetrical about said rake line, a maximum thickness at said rake line, rounded leading edges and the same surface blade rake on both the fore and aft faces of said blades.

2. The propeller defined in claim 1 wherein said blades are symmetrical in thickness about the nose-tail pitch lines thereof.

3. The propeller defined in claim 2 and having three blades.

4. The propeller defined in claim 3 wherein the roots of said blades each extend approximately 120 degrees around said hub.

5. The propeller defined in claim 4 wherein said hub comprises a flared trailing edge surrounding said exhaust opening.

* * * * *